US005911808A

United States Patent [19]

Mendenhall

[11] Patent Number: 5,911,808

[45] Date of Patent: Jun. 15, 1999

[54] TENSIONED BLADE APPARATUS

[76] Inventor: George Mendenhall, 4252 S. Eagleson Rd., Boise, Id. 83705

[21] Appl. No.: 08/949,610

[22] Filed: Oct. 14, 1997

[51] Int. Cl.[6] ..... B26D 5/00

[52] U.S. Cl. ..... 83/581.1; 83/402; 83/425.3; 83/662; 83/857; 83/858; 83/932; 30/117

[58] Field of Search ..... 83/402, 425.2, 83/425.3, 581.1, 651.1, 662, 699.11, 856, 857, 858, 932; 30/117, 305

[56] References Cited

U.S. PATENT DOCUMENTS

| | | | |
|---|---|---|---|
| 2,219,963 | 10/1940 | Rieder . | |
| 2,283,030 | 5/1942 | Bakewell . | |
| 2,611,404 | 9/1952 | Weeks . | |
| 2,621,691 | 12/1952 | Brualdi . | |
| 3,519,048 | 7/1970 | Reifenhauser . | |
| 4,059,037 | 11/1977 | Gerson et al. | 83/407 |
| 4,383,365 | 5/1983 | Metzigian | 30/114 |
| 5,095,794 | 3/1992 | Mendenhall | 83/853 |

*Primary Examiner*—Peter Vo
*Assistant Examiner*—Kevin G. Vereene
*Attorney, Agent, or Firm*—Marger Johnson & McCollom, P.C.

[57] ABSTRACT

A multiblade cutting assembly including a plurality of blades and a blade support which is loaded as a simple beam. A plurality of parallel cutting blades are mounted by a first end on a frame and by a second end on a tension member. A pair of biasing members bear against the frame and simultaneously apply a tension force to the blades. Multiple cutting assemblies as described can be stacked with the blades of the respective cutting assemblies in close proximity for improved cutting.

13 Claims, 5 Drawing Sheets

TENSIONED BLADE APPARATUS

BACKGROUND OF THE INVENTION

This invention relates to a cutting apparatus, and in particular, to a cutting apparatus for use in high-volume food processing.

Food products and produce such as potatoes are cut and shaped by being entrained in a high velocity stream of water and passed through a "hydroknife" blade assembly. A hydroknife blade assembly typically includes multiple blades for cutting the produce into the desired shape and size. For example, the hydroknife cutter assembly disclosed in U.S. Pat. No. 5,095,794 is used for cutting potatoes into elongate, square cross-sectioned pieces for further processing into french fries.

SUMMARY OF THE INVENTION

This invention is embodied in a multiblade cutter which includes a frame having a bottom wall having a bore, a first and second sidewalls having transverse holes adjacent each end. A multiblade assembly is mounted on the frame. The blade assembly includes multiple, generally parallel blades affixed at each end to first and second blade mounting assemblies. Each blade mounting assembly preferably include mounting blocks interleaved with the blades, and a nut and bolt assembly received through the blade ends and the mounting blocks. The blade assembly is attached to the frame at the first end by a pin. A blade tensioner is connected to the second end of the blade assembly, and includes a biasing member which bears against the ends of the frame sidewalls to tension the blades. In the preferred embodiment, the biasing member includes a pair of tension bolts which are threaded through the tensioner.

The invention is also embodied in an assembly in which two such multiblade cutters are assembled with their respective blades oriented at 90°. The two cutters are bolted together placing their respective blades in very close proximity. The close proximity of the two sets of blades minimizes the distance which the food product travels between blade sets, reducing losses due to rotation or tumbling of the product between the blade sets. The paired cutters are mounted in a housing which incorporates compression fittings to seal inlet and outlet tubes to the assembly.

DETAILED DESCRIPTION

A cutting assembly according to the present invention is adapted for use with food processing systems in which potatoes, for example, are delivered to cutting assemblies in a high-speed stream of water. The stream of water carrying the produce is directed through the cutting assemblies to cut the produce into the desired shape. In the preferred embodiment of the invention, potatoes are cut into square cross-section strips for french fries. The invention is not, however, limited to any particular food product, nor to a square cross-section food product. It is anticipated that the invention could have applications in cutting other food products and non-food products into square cross-section pieces, and into other shapes as well.

Figure 1:
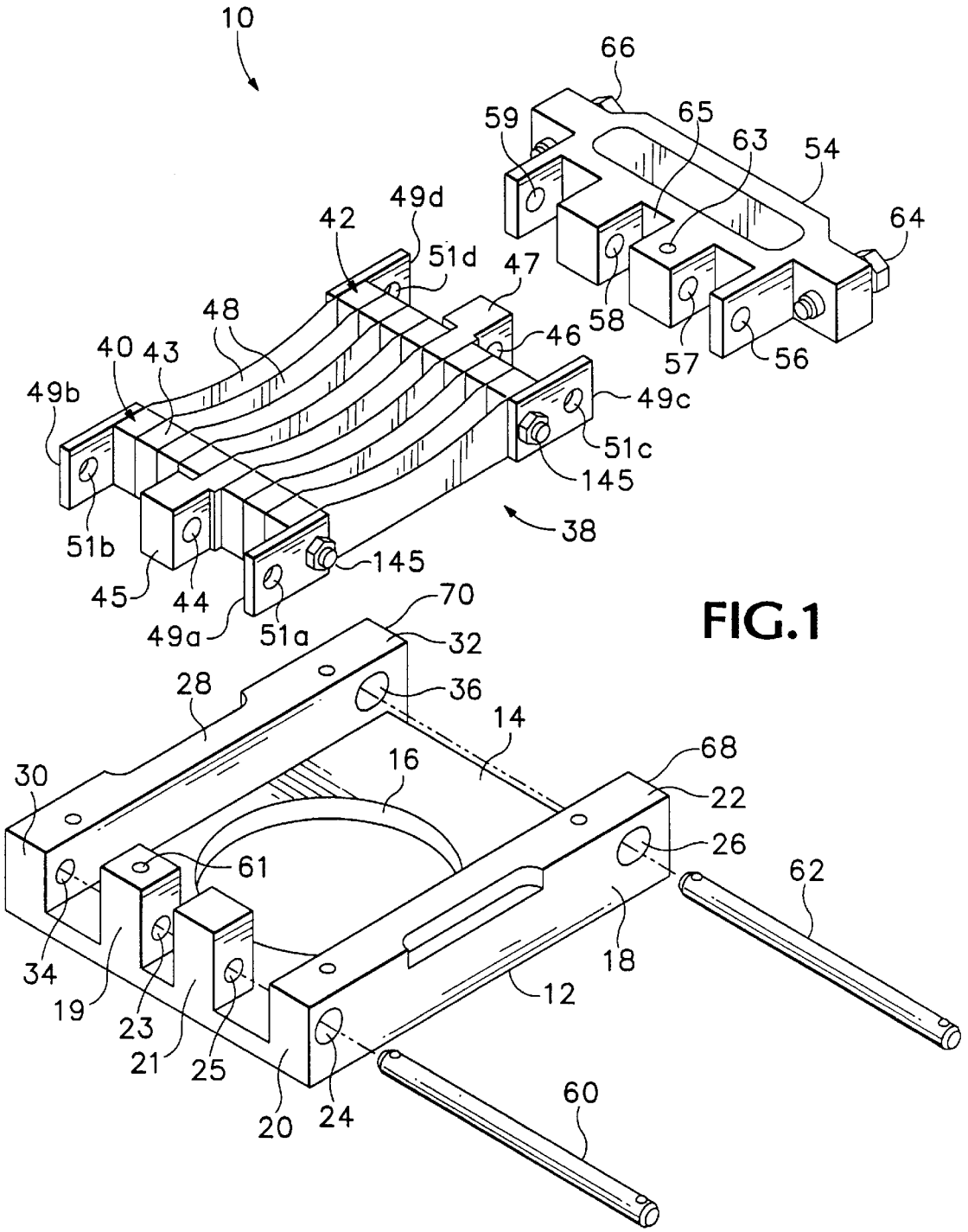
FIG. 1 is an exploded perspective view of a multiblade cutter according to the invention.
Figure 2:
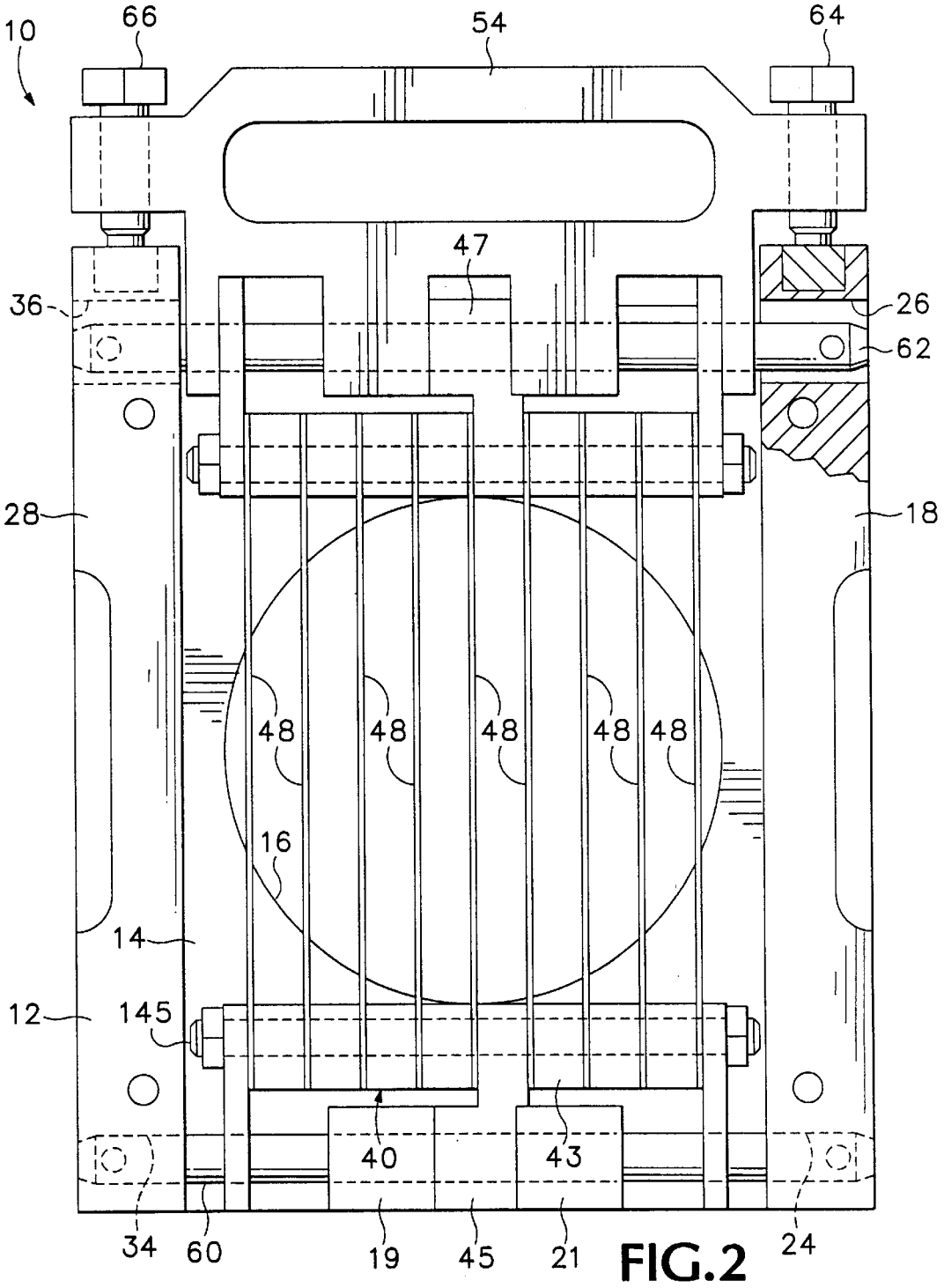
FIG. 2 is a top plan partial cutaway view of the multiblade cutter shown in FIG. 1.

Turning now to FIGS. 1 and 2, a multiblade cutter according to the invention is shown generally at 10. Cutter 10 includes a frame 12 having a bottom wall 14 and opening 16 through which product enters the cutter. Frame 12 includes sidewalls 18 and 28. Each sidewall preferably extends the length of the frame 12, and includes a transverse hole adjacent each sidewall end (24, 26, 34, 36). Each sidewall also includes a longitudinal recess 37. Raised bosses 19 and 21 are provided at a first end of the frame and between the sidewalls. Raised bosses 19 and 21 extend above a plane defined by the upper edges of sidewalls 18 and 28. Bores 23 and 25 are provided in raised bosses 19 and 21.

Figure 3:
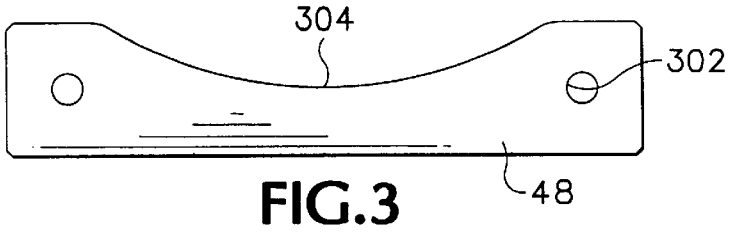
FIG. 3 is a side elevational view of a preferred blade design for use in the cutter shown in FIGS. 1–3.

A multiblade sub-assembly for mounting on frame 12 is shown generally at 38. Blades 48 are mounted at each end in blade mounting assemblies 40 and 42. The preferred embodiment of blade 48, as shown in FIG. 3, is flat and generally rectangular, with a vertically-centered mounting hole 302 near each end. A concave cutting surface 304 is formed in the upper half of the blade, preferably above the longitudinal centerline of the blade. In cross section, the blade is slightly thicker at the center of the cutting edge to prolong blade life. The preferred blade design reduces fatigue-related failures by eliminating sharp corners along the blade surface, and provides improved cutting performance for a variety of food products. The invention is not limited to this preferred blade design, there being numerous alternative blade configurations which could be substituted.

Returning now to FIGS. 1 and 2, each blade mounting assembly preferably includes multiple compression blocks 43 interleaved with the blades 48. Each blade end and compression block includes a bore for receiving a bolt and nut assembly 45. Center compression blocks 46 and 47 and end blocks 49*a–d* include respective second bores 44, 46 and 51*a–d* for receiving pins 60 and 62. The center compression block 45 is sized to fit closely between bosses 19 and 21 to limit lateral movement of the blade assembly relative to the frame. Blade assembly 38 is positioned in frame 12 with the center compression block 45 between bosses 19 and 21. Pin 60 is inserted through holes 24, 51*a*, 25, 44, 23, 51*b* and 34, and locked into place with a set screw 61.

A blade tensioner 54 is then connected to the opposite end of the blade assembly and frame. Tensioner 54 includes transverse holes 56–59, and a recess 65 which sized to closely receive central compression block 47 and limit lateral movement of the blade assembly. Tensioner 54 is mounted to the assembly by pin 62 which is inserted through holes 56–59, 26, 51*c*, 46, 51*d* and 36. Pin 62 is locked into place by set screw 63. Tensioning bolts 64 and 66 are threaded through tensioner 54. The blades are tensioned by tightening tensioning bolts 64 and 66 against end walls 68 and 70, thereby urging tensioner 54 away from frame 12. Holes 26 and 36 are preferably elongated in the direction of the tensioning force exerted on the blades, thus providing the required relative movement of pin 62 and tensioner 54 relative to the frame 12. In the preferred embodiment, hardened inserts (not shown) are pressed into the end surfaces of sidewalls 18 and 28. The hardened inserts provide increased resistance against wear of the frame by the tensioning bolts, and thereby provide a more consistent blade tension over the life of the cutter. In another aspect of the invention, blade assembly 38 and blade tensioner 54, when mounted in frame 12, are flush with, or several thousandths of an inch below the upper surface of sidewalls 18 and 28.

Figure 4:
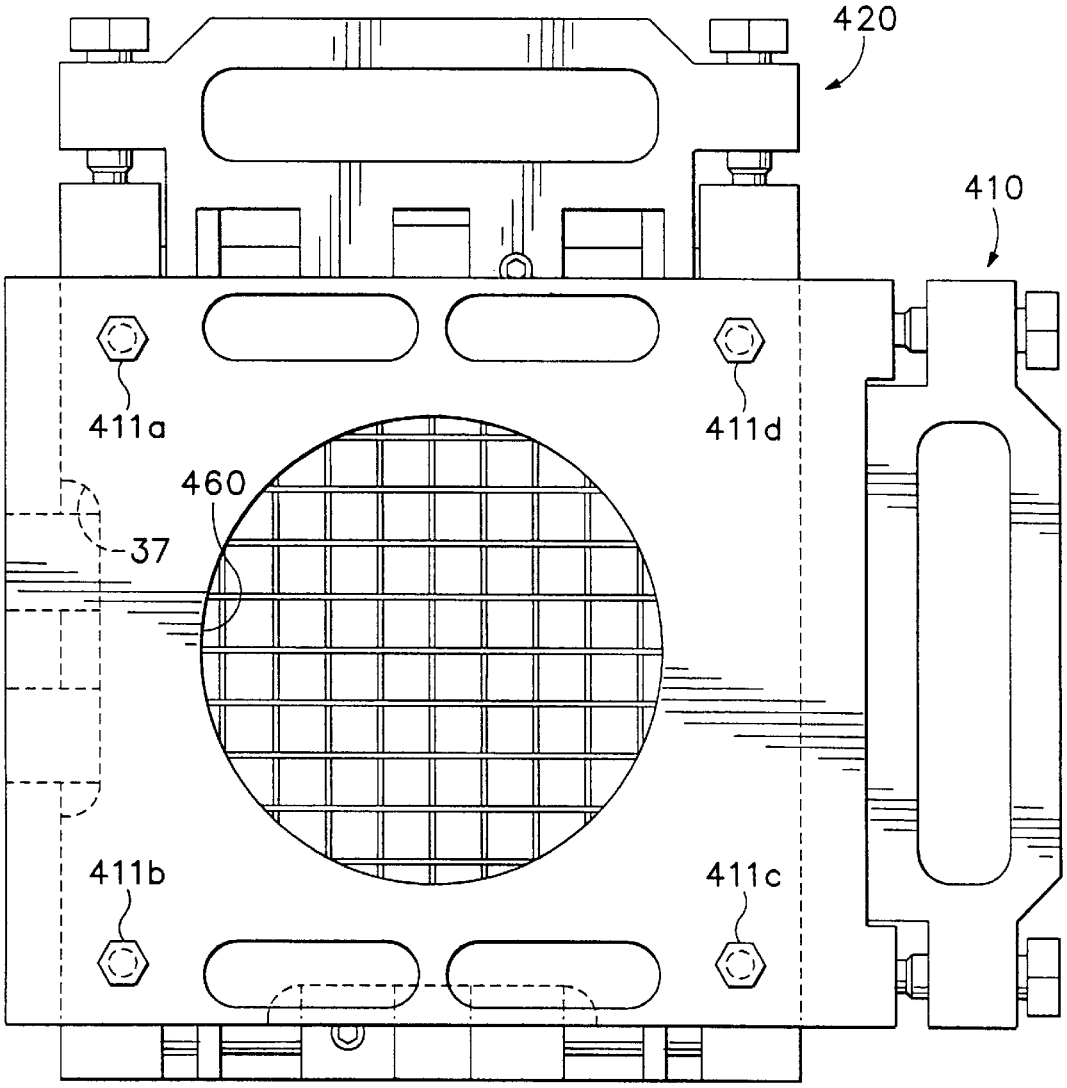
FIG. 4 is a top view of a preferred embodiment of the invention wherein a pair of cutters as shown in FIG. 1 are joined together at right angles to produce square-cut products.

Turning to FIG. 4, in a preferred embodiment of the invention, a pair of multiblade cutters 410 and 420, each as described above and shown in FIGS. 1–3, are bolted together by bolts 411*a–d* as shown to provide a cutter assembly for producing square cross-section products such as french fries. As mentioned above, bosses 19 and 21 protrude above the plane of sidewalls 18 and 28.

As mentioned above, the top edges and surfaces blade assembly 38 of each of multiblade cutters 410 and 420 are essentially flush with the upper sidewall edges. As a result, a product passing through this embodiment of the invention travels only a very short distance, preferably only several thousandths of an inch, between cutting blades. By minimizing the distance travelled between the cutters, the orientation of the food product is less affected by the extreme turbulence of the fluid in which the food product is being transported through the cutters. By maintaining better control over the orientation of the food product between cutting stages, product quality and yield are both improved.

Figure 4A:
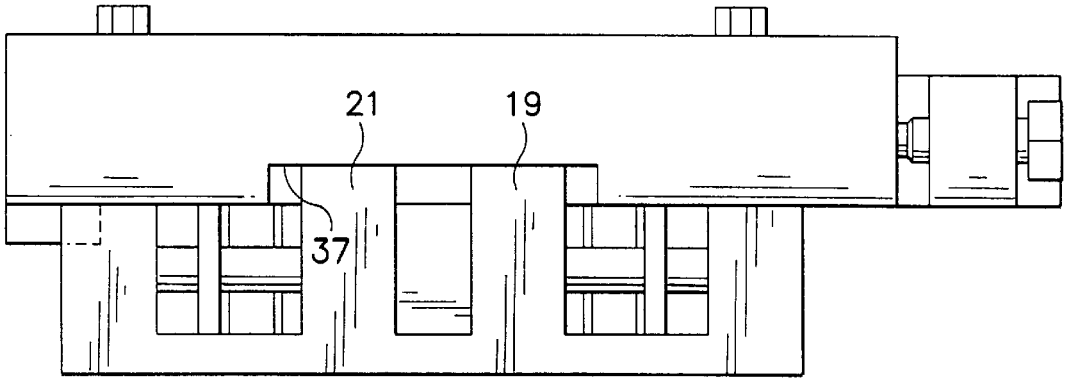
FIG. 4A is a side cross-sectional view of the embodiment shown in FIG. 4, and showing in particular the raised bosses of the upper cutter received in the sidewall recess of the lower cutter frame, and thereby supported as simple beams.

Turning now to FIG. 4A, when the pair of multiblade cutters are bolted together as shown in FIG. 4, the distal portions of the raised bosses 19 and 21 on each cutter, which protrude above the plane of the sidewalls, are received within longitudinal recess 37 of the other multiblade cutter as best seen in FIG. 4A. This improvement over the cutters of the prior art provides very important advantages. First, as the tensioning forces are exerted in the blades as described above, the raised bosses of the prior art cutters, which do not extend above the sidewalls and into recess 37, are loaded as cantilevered beams, i.e. they are supported only at the lower end, and tend to deflect under the relatively high tensioning force of about 10,000 pounds which is typically exerted on the cutting blades. In order to resist the deflection of the bosses, the bottom wall of frame 12 is relatively thick, typically ½", in prior art cutters. In the present invention, by supporting the raised bosses as simple beams, a significant portion of the load from the blade tensioners is supported by the side walls, reducing the load transmitted to the bottom wall of each frame 12. As a result, the thickness of frame 12 can be significantly reduced, to about ¼". This reduction in the thickness of the bottom wall translates directly into a significant improvement in the operation of the cutter. Where a multiblade cutter of this general type is used to slice potatoes, a critical parameter affecting the yield of desired product from the cutting step is the degree of rotation of the product from the time it enters the cutter until it engages the first blade set. For example, a rotation of the product of only about 5° within the cutter can reduce to yield of acceptable product from about 80% to as low as about 20%. Control of the orientation of the incoming produce is rendered very difficult by the extreme turbulence of the water stream within the cutter. In the prior art, the bottom wall thickness of about ½" represents a distance which the produce must travel before engaging the blades, and during which the produce can "tumble" out of alignment. A cutting assembly according to the present invention, on the other hand, reduces the bottom wall thickness, and therefore the distance the produce must travel before engaging the blades, by about ¼ inch, or 50% in the typical scenario.

In another aspect, the supporting of the raised bosses as simple beams according to the invention permits a significant overall weight reduction to be achieved, which eases handling and reduces risk of injury when handling the cutters. As discussed above, the novel arrangement of the present invention permits a reduction by about half of the thickness, and therefore the weight of the bottom wall. In addition, the size and weight of the raised bosses can also be reduced. The result is that the overall weight of a cutter assembly according to the present invention can be reduced by 30–50% compared to that of a similar cutter employing a prior art cantilever boss design. The reduced weight of a cutting assembly according to the present invention eases the difficulty of installing and removing the cutter assembly, which can be wet and slippery to handle.

Figure 5:
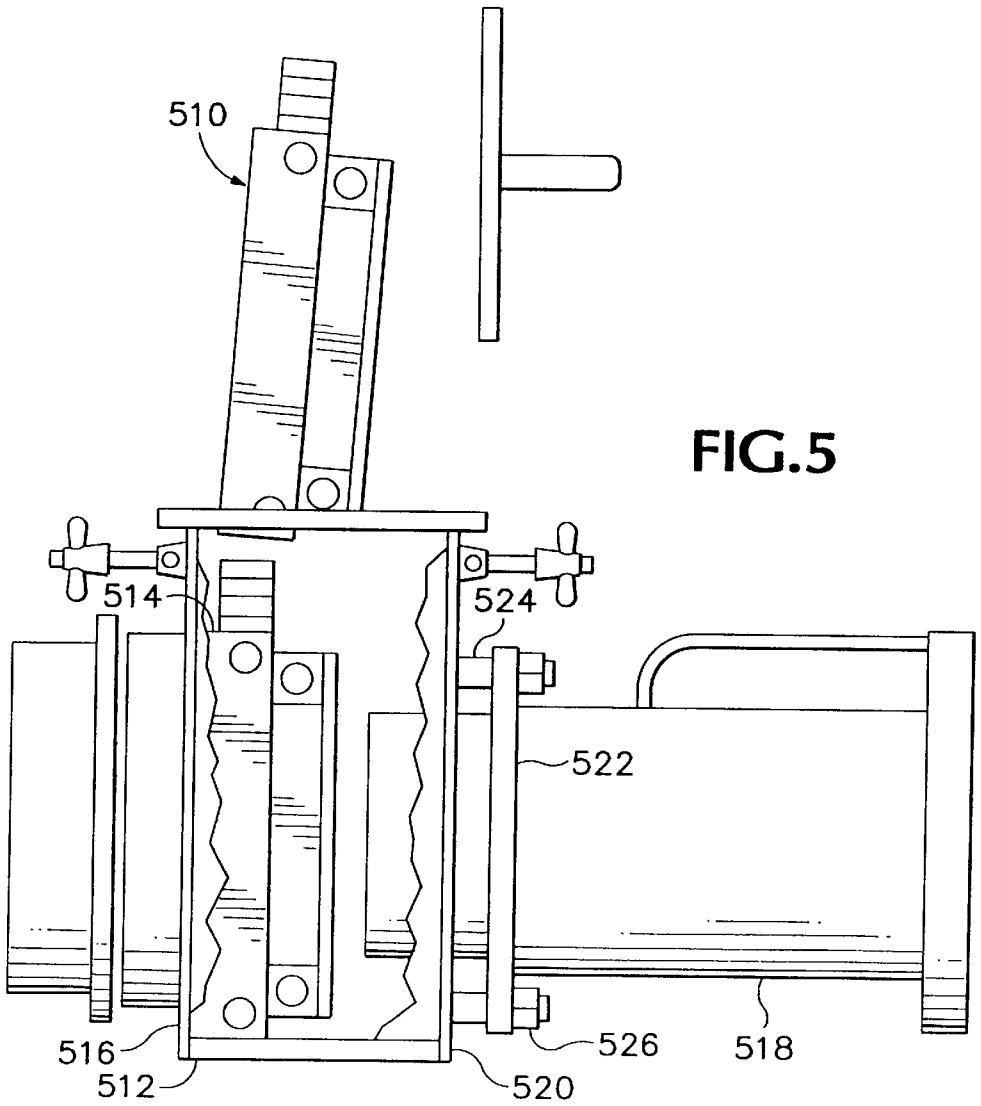
FIG. 5 is a partial cutaway side view of the embodiment of FIG. 3 mounted in a housing, and showing an inlet and an outlet for conducting product to and from the cutting assembly.
Figure 6:
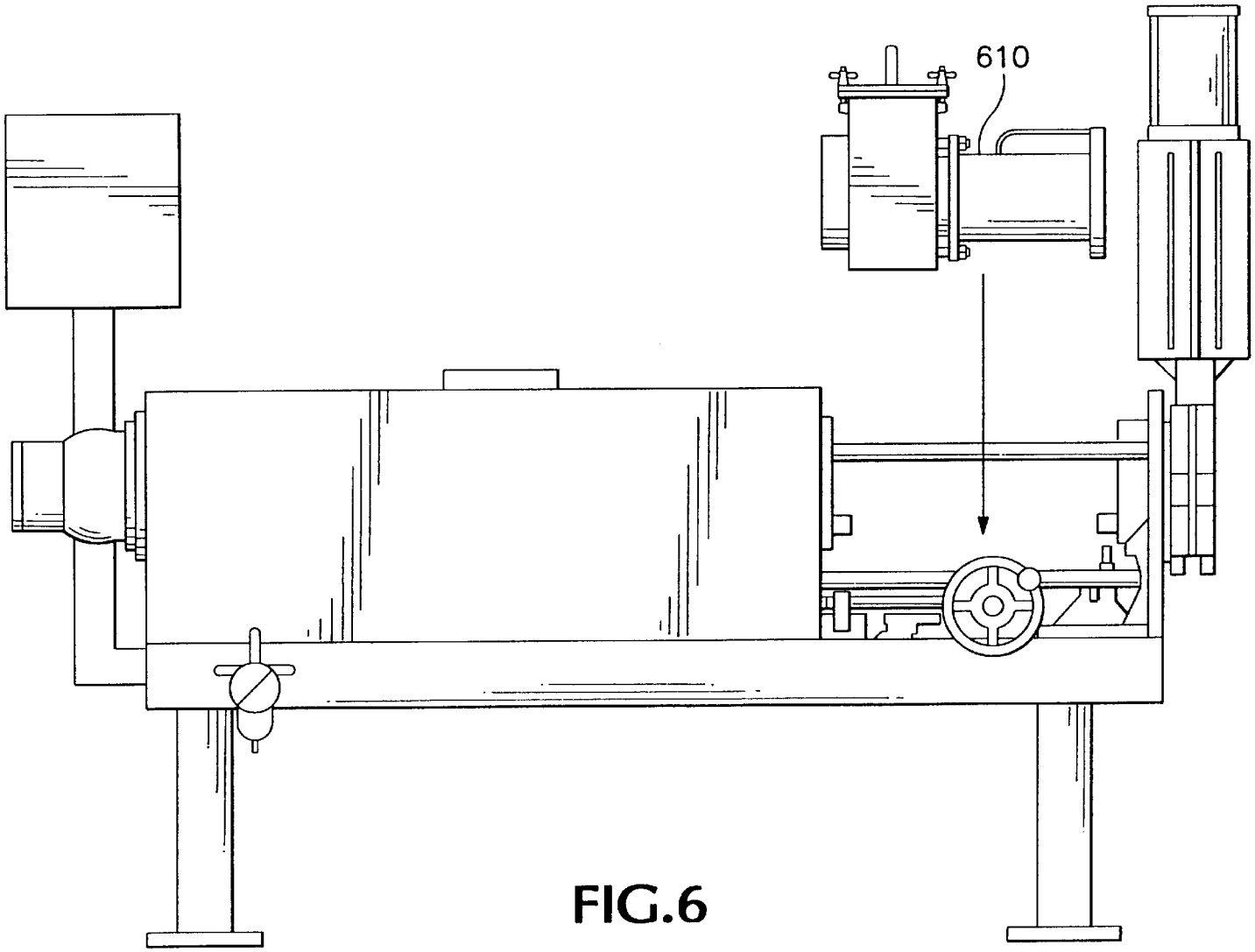
FIG. 6 shows the housing and cutter assembly of FIGS. 1–5 installed in a hydroknife apparatus.

Turning now to FIG. 5, the embodiment of FIG. 4, shown rally at 510, is preferably received within a housing The inlet side 514 of cutter assembly 510 is placed against wall 516. Outlet tube 518 is inserted through wall and is received within bore 460 (FIG. 4). Outlet tube includes flange 522. Holes in flange 522 fit over studs and nuts 526 are tightened to urge outlet tube 518 into sealing engagement with bore 460, and the inlet side 514 against wall 516. The housing together with the cutting assembly, shown at 610, are then mounted in the hydroknife apparatus as shown generally in FIG. 6.

Although the invention has been described by reference to foregoing embodiments, those skilled in the art will appreciate that numerous changes in detail and arrangement possible without departing from the scope of the following claims.

I claim:

1. A cutting apparatus (10) comprising:

a frame (12) having a bottom wall (14) including surfaces defining an opening (16), a first sidewall (18) having first and second end portions (20, 22) including respective surfaces defining first and second transverse holes (24, 26), and a second sidewall (28) having first and second end portions (30, 32) including surfaces defining respective third and fourth transverse holes (34, 36), at least one of said sidewalls having a longitudinal recess formed therein;

a first blade assembly (38) mounted on the frame (12) and comprising first and second blade mounting assemblies (40, 42), surfaces defining respective fifth and sixth transverse holes (44, 46), a plurality of elongate blades (48), each blade having first and second ends (50, 52) mounted in the respective first and second blade mounting assemblies (40, 42);

a first blade tensioner (54) including surfaces defining seventh and eighth transverse holes (56, 58); a first retainer (60) received in the first, third and fifth transverse holes (24, 34, 44); a second retainer (62) received within the second, fourth and seventh and eighth transverse holes (26, 36, 56, 58), at least one biasing member bearing on the frame (12); and the frame having at least one raised blade support member having a distal portion.

2. The cutter of claim 1 wherein the at least one biasing member includes at least one tensioning bolt bearing on the frame.

3. The cutter of claim 1 wherein the at least one biasing member includes first and second tensioning bolts (64, 66)

engaged with the blade tensioner and bearing on respective end surfaces (68, 70) of the first and second sidewalls (18, 28).

4. The cutter of claim 1 wherein the second retainer is a second pin, and wherein the second and fourth holes have a dimension greater than a cross-sectional dimension of the second pin.

5. The cutter of claim 1 wherein each of said first and second blade mounting assemblies includes at least one mounting block interleaved with the plurality of blades and a nut and bolt assembly received through the at least one mounting block.

6. The cutter of claim 1 wherein the second retainer is substantially fixed relative to the second blade mounting assembly and movable relative to the frame.

7. A cutting assembly comprising:

a first multiblade cutter comprising a plurality of spaced apart, generally parallel blades;

a second multiblade cutter comprising a plurality of spaced apart, generally parallel blades;

the second multiblade cutter mounted on the first multiblade cutter, the plurality of blades of the second cutter disposed at an angle to the plurality of blades of the first multiblade cutter;

each of said first and second multiblade cutters comprising:

a frame (12) having a bottom wall (14) including surfaces defining an opening (16) and first and second raised blade support members having a distal end, a first sidewall (18) and a second sidewall (28);

the first sidewall (18) having first and second end portions (20, 22), having surfaces defining a first longitudinal recess and first and second transverse holes (24, 26); and, the second sidewall (28) having first and second end portions (30, 32) including surfaces defining a second longitudinal recess and respective third and fourth transverse holes (34, 36);

a first blade assembly (38) mounted on the frame (12) and comprising first and second blade mounting assemblies (40, 42), surfaces defining respective fifth and sixth transverse holes (44, 46), a plurality of elongate blades (48), each blade having first and second ends (50, 52) mounted in the respective first and second blade mounting assemblies (40, 42);

a first blade tensioner (54) including surfaces defining seventh and eighth transverse holes (56, 58); a first retainer (60) received in the first, third and fifth transverse holes (24, 34, 44); a second retainer (62) received within the second, fourth and seventh and eighth transverse holes (26, 36, 56, 58), at least one biasing member bearing on the frame (12); and the distal end of the first raised blade support member received within the second longitudinal recess in the second sidewall (28), and the distal end of the second raised blade support member received within the first longitudinal recess in the first sidewall (18).

8. The cutting assembly of claim 7 wherein the at least one biasing member includes at least one tensioning bolt bearing on the frame.

9. The cutting assembly of claim 7 wherein the at least one biasing member includes first and second tensioning bolts (64, 66) engaged with the blade tensioner and bearing on respective end surfaces (68, 70) of the first and second sidewalls (18, 28).

10. The cutting assembly of claim 7 wherein the second and fourth holes have a dimension greater than a cross-sectional dimension of the second retainer.

11. The cutting assembly of claim 7 wherein each of said first and second blade mounting assemblies includes at least one mounting block interleaved with the plurality of blades and a nut and bolt assembly received through the at least one mounting block.

12. The cutting assembly of claim 7 further comprising a housing supporting the first and second multiblade cutters, an inlet conduit communicating with the first multiblade cutter, and an outlet conduit communicating with the second multiblade cutter.

13. The cutter of claim 7 wherein each second retainer is substantially fixed relative to its respective second blade mounting assembly and movable relative to its respective frame.

* * * * *